US006113201A

United States Patent [19]

Bauer

[11] Patent Number: 6,113,201

[45] Date of Patent: Sep. 5, 2000

[54] CABINET RAIL

[75] Inventor: Thomas E. Bauer, Saginaw, Mich.

[73] Assignee: Case Systems, Inc., Midland, Mich.

[21] Appl. No.: 09/191,773

[22] Filed: Nov. 13, 1998

[51] Int. Cl.[7] ..... A47B 96/06

[52] U.S. Cl. ..... 312/245; 312/246

[58] Field of Search ..... 312/245, 246; 108/152; 248/225.21, 225.11; 211/90.01, 90.04, 87.01, 94.01; 52/27, 36.5

[56] References Cited

U.S. PATENT DOCUMENTS

| | | | |
|---|---|---|---|
| 3,241,850 | 3/1966 | Propst | 312/246 X |
| 3,698,565 | 10/1972 | Weber | 211/87.01 |
| 5,624,168 | 4/1997 | Licciardello, Sr. | 312/245 |

*Primary Examiner*—Janet M. Wilkens

*Attorney, Agent, or Firm*—Price, Heneveld, Cooper, DeWitt and Litton

[57] ABSTRACT

A wall rail system includes a cabinet rail having a base portion and a hook portion which projects away and downwardly from the base portion, the front of the cabinet rail being free of sharp edges, and an elongate wall rail including a base portion and a hook portion which projects away and downwardly from the base portion, with the front of the elongate wall rail also being free of sharp edges, whereby the front of the cabinet rail can smoothly slide over the front of the wall rail and guide the hook portion of the cabinet rail into a channel defined by the base portion and hook portion of the elongate wall rail during installation of a cabinet unit. The absence of sharp edges on the fronts of the wall rail and cabinet provide easier installation and reduce the potential for damage to walls and/or cabinet units by inadvertent contact with the rails during installation.

13 Claims, 2 Drawing Sheets

CABINET RAIL

FIELD OF THE INVENTION

This invention relates to a cabinet rail hanging system for supporting standard prefabricated cabinet units on walls.

BACKGROUND OF THE INVENTION

Standard prefabricated cabinet units are commonly mounted on walls in laboratories, hospitals, schools, commercial and institutional kitchens, and the like, using a cabinet rail system comprising a wall rail and one or more cabinet rails. The wall rail is typically a continuous extrusion having a cross-sectional configuration which includes a planar back portion and an upwardly-turned hook portion. The wall rail generally includes a plurality of fastener openings which are uniformly spaced apart along the length of the wall rail to facilitate mounting of the wall rail to a wall. The cabinet rails may be made by cutting an extruded rail to a desired length. The cabinet rail has a cross-sectional configuration which includes a planar back portion and a downwardly-turned hook portion, and generally includes a plurality of fastener openings for securing the cabinet rail to the back side of a prefabricated cabinet unit. A single cabinet rail having a length which corresponds to at least a substantial portion of the width of a cabinet unit may be mounted to the back side of the cabinet unit, or, alternatively, two or more cabinet rails of shorter length can be mounted to the back side of the cabinet unit in spaced apart relationship. In either case, the wall rail is secured to a wall, such as with screws, with the planar back portion of the wall rail abuttingly engaging a planar surface of a wall on which the cabinet units are to be suspended, and with the hook portion of the wall rail turned upwardly. The cabinet rail(s) is (are) secured to the back side of the cabinet unit, such as with screws, with the planar back portion of the cabinet rail abuttingly engaging a planar surface of the back side of the cabinet unit, and with the hook portion of the cabinet rail turned downwardly. The upwardly projecting hook portion on the wall rail defines a channel or groove in which the downwardly projecting hook portion on the cabinet rail may be received. A cabinet unit can be quickly and easily suspended from a wall by positioning the cabinet unit with the downwardly projecting hook portion(s) of the cabinet rail adjacent to and slightly above the channel defined by the upwardly projecting hook portion of the wall rail, and then repositioning cabinet unit slightly downwardly and toward the wall to insert the downwardly projecting hook portion of the cabinet rail into the channel defined by the upwardly projecting hook portion of the wall rail. Such cabinet rail systems provide a relatively simple hook-on installation method which is economical and which provides easy replacement and repositioning of cabinet units as desired.

The cabinet rail systems which have been commercially available typically include rails with sharp corners and edges defined by intersecting planar or flat surfaces. Accordingly, cabinet units must be precisely manipulated during installation in order to properly engage the cabinet rail with the wall rail to suspend a cabinet unit. Such precise manipulation can be difficult, especially when larger and/or heavier cabinet units are being installed, and may, therefore, require additional labor. For example, it may be necessary to have one worker lift a cabinet unit to an approximate installation position, while another worker precisely guides the cabinet unit into the installed position.

Another disadvantage with the sharp corners and edges of currently available cabinet rail systems is that the sharp corners and edges can cause damage to walls or cabinet units through inadvertant contact during lifting and manipulation of the cabinet units, such as at the time of installation.

A further disadvantage with currently available cabinet rail systems is that the wall rail must be installed in an upright position, i.e., with the hook-like projection projecting upwardly. As a result, the currently available wall rails can be inadvertently secured to a wall in an improper upside-down position, such as by an inattentive worker or a worker who is unfamiliar with the cabinet rail system. In such case, the wall rail must be removed and installed in the proper upright position to facilitate hook-on installation of the cabinet units.

SUMAMRY OF THE INVENTION

This invention relates to a cabinet rail hanging system which overcomes the above noted problems with currently available cabinet rail systems.

In accordance with one aspect of the invention, a cabinet rail systems includes an elongate rail having a front which is free of sharp edges, and a cabinet rail which is also free of sharp edges, whereby the front of the cabinet rail can smoothly slide over the front of the wall rail and guide a hook portion of the cabinet rail into a channel defined by a base portion and a hook portion of the elongate wall rail during installation of a cabinet unit.

In accordance with another aspect of the invention, there is provided a wall rail system including a cabinet rail having a hook portion, and an elongate wall rail having a first hook portion which projects away and downwardly from the base portion and a second hook portion which projects away and upwardly from the base portion and toward the first hook portion of the elongate wall rail, whereby the elongate wall rail may be secured to a wall in either of two equivalent orientations to eliminate the possibility of securing the wall rail to a wall in an inoperable upside-down orientation.

DESCRIPTION OF THE PREFERRED EMBODIMENTS

Figure 1:
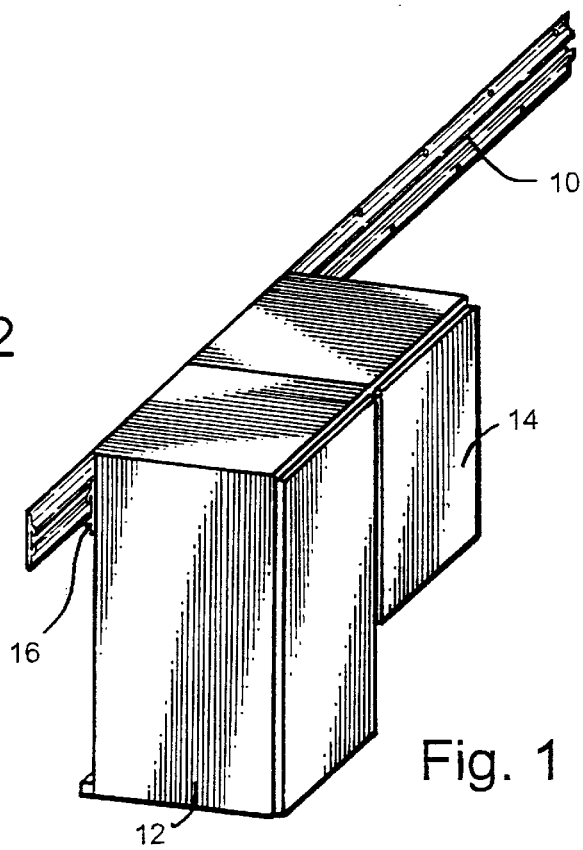
FIG. 1 is a perspective view showing a plurality of cabinet units mounted to a wall using the cabinet rail system of this invention.
Figures 4A, 4B, 4C, 4D, 4E, 4F, 4G, 4H:
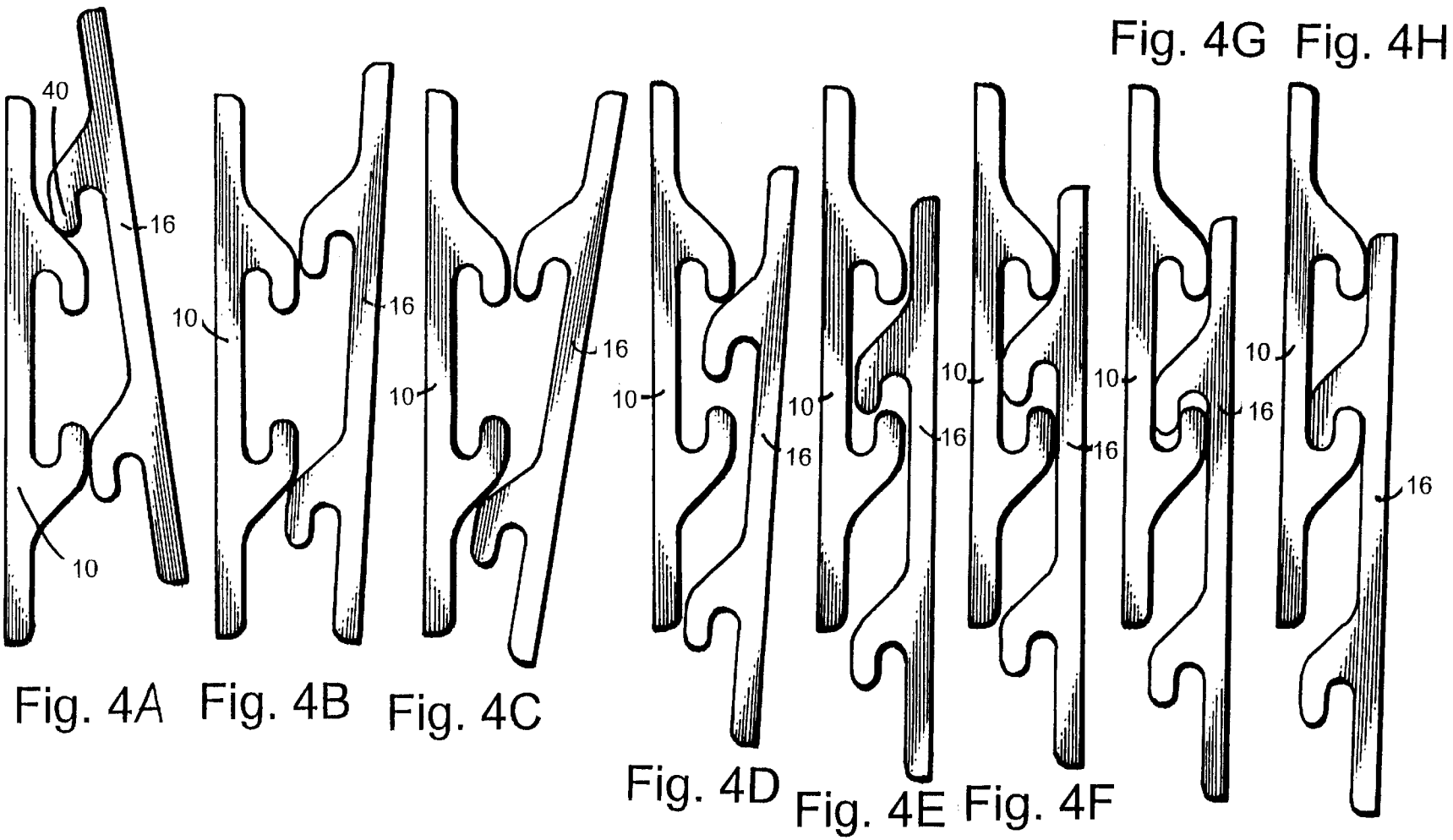
FIGS. 4A–4H are side elevational views progressively illustrating the position of a cabinet rail relative to a wall rail during installation of a cabinet unit.

In FIG. 1, there is shown a cabinet installation utilizing a cabinet rail system in accordance with a preferred embodiment of this invention. The cabinet rail system includes a wall rail 10 which may be secured to a vertical wall, such as with screws. Other fasteners, such as nails, can be used as an alternative, if desired. As another alternative, adhesives or a combination of adhesives and fasteners, such as screws and/or nails, may be used for securing wall rail 10 to a wall. Cabinet units 12, 14 are suspended from wall rail 10 by means of cabinet rail 16 secured to the back side of cabinet units 12, 14. Cabinet rails 16 can be secured to the back side of cabinet units 12, 14 with fasteners, such as screws or nails, adhesives, or a combination of adhesives and fasteners.

Figure 2:
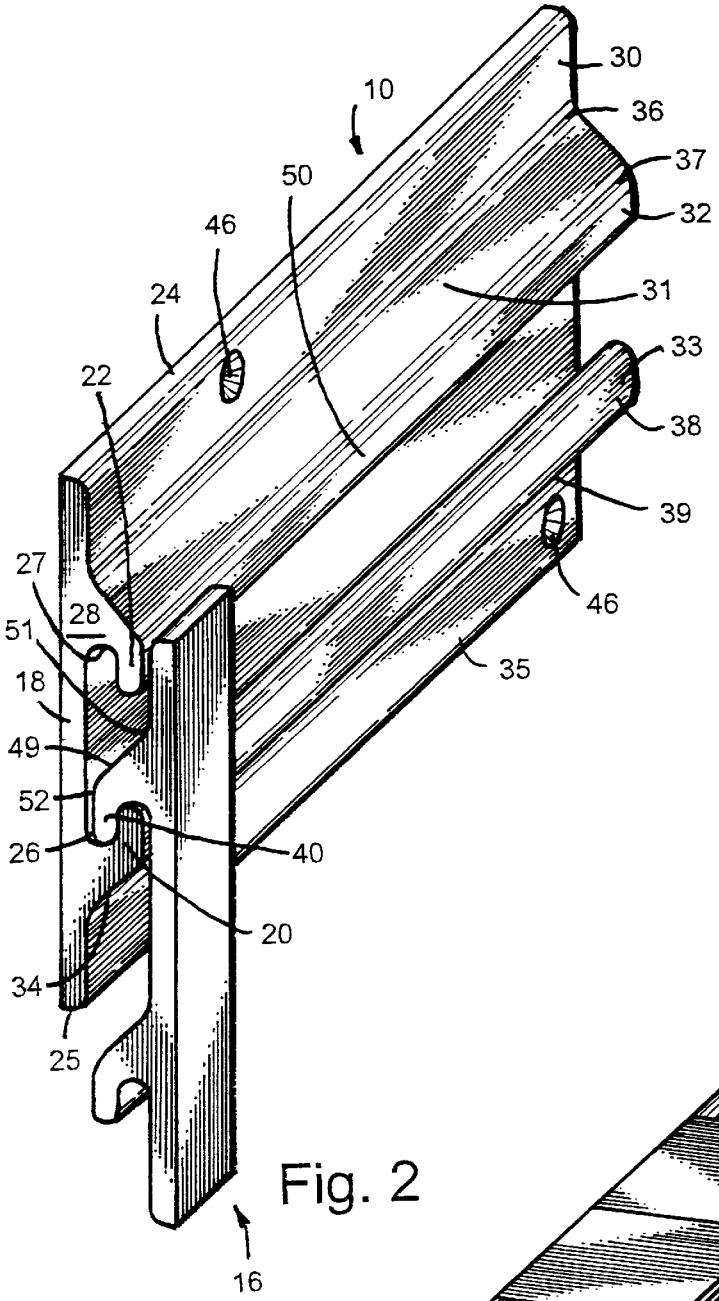
FIG. 2 is a perspective view showing the manner in which a cabinet rail engages a wall rail in accordance with the invention.

FIG. 2 shows how a cabinet rail 16 engages wall rail 10 to provide a simple hook-on installation method for suspending cabinet units from a vertical wall. Wall rail 10 includes a planar base portion 18, a downwardly projecting hook portion 22, and an upwardly projecting hook portion 20. In the illustrated embodiment, hook portions 20 and 22 are mirror images of each other. In fact, the illustrated wall rail 10 is symmetrical (except for fastener openings 46) with respect to an imaginary horizontal plane intersecting wall rail 10 midway between upper edge 24 and lower edge 25 of wall rail 10.

Hook portions 20, 22 project away from base portion 18 and toward each other to define grooves or channels 26, 27 which open toward each other. Because the upwardly projecting hook portion 20 and downwardly projecting hook portion 22 are identically shaped, and because wall rail 10 is symmetrical with respect to a horizontal plane intersecting wall rail 10 midway between the upper edge 24 and lower edge 25, wall rail 10 can be properly secured to a wall in either of two equivalent orientations, i.e., wall rail 10 cannot be secured to a wall in an inoperable upside-down orientation.

Figure 3:
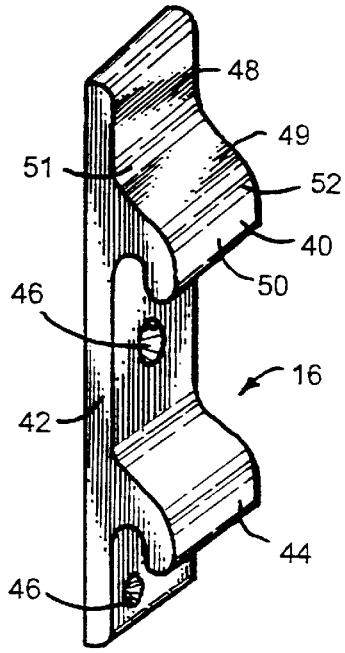
FIG. 3 is a perspective view showing the front side of the cabinet rail shown in FIGS. 1 and 2.

At opposite ends of wall rail 10 are end surfaces 28. In most cases, wall rails 10 will be shipped to a point of use in standard pre-cut lengths, and will be cut to any desired length at the point of use, as required. Although it is conceivable that the ends of wall rail 10 could be rounded or curved near the edges of the end surfaces 28, it is more economical and practical to simply cut extruded wall rail 10 to any desired length (either at the point of use or before shipment to the point of use) and allow end surfaces 28 to remain substantially planar or flat. However, all flat surfaces (e.g., 30, 31, 32, 33, 34 and 35) on the front side of wall rail 10 (i.e., those surfaces which would be visible in a front view of rail 10) are separated by smoothly curved surfaces (e.g., 36, 37, 38 and 39). Stated differently, there are not any intersecting flat surfaces on the front side of wall rail 10 which would form a sharp edge. As a result, cabinet units, such as 12, 14, are not as likely to be damaged by inadvertant contact with wall rail 10, such as during installation of cabinet units 12, 14 on wall rail 10. The alternating smooth and curved surfaces on the front side of wall rail 10 form a ramp which can cooperatively interact with similar surface features on a cabinet rail 16 to smoothly guide downwardly projecting hook portions 40 (FIG. 3) of cabinet rail 16 into channel 26 of wall rail 10, as will be discussed herein below.

Cabinet rail 16 includes a planar base portion 42, and at least one downwardly projecting hook portion 40 which is configured identically to hook portion 22 of wall rail 10. In the illustrated embodiment, cabinet rail 16 includes a second downwardly projecting hook portion 40 which is also configured identically to hook portion 22 of wall rail 10. Cabinet rail 16 can be provided with any number of downwardly projecting hook portions (such as 40, 44) to provide height adjustability (such as for cabinet units 12 and 14).

Wall rail 10 and cabinet rail 16 are preferably made of extruded aluminum, and are cut to desired lengths. Wall rails 10 are typically cut to a length equal to the total length of the cabinetry being installed on a wall. For particularly long cabinetry installations, a plurality of wall rails 10 may be secured to a wall in end-to-end relationship to achieve the desired length. The cabinet rail 16 can be cut to lengths equal to the width of a cabinet unit 12, 14, or at least equal to a substantial portion of the width of a cabinet unit 12, 14, if it is desired to suspend each of the cabinet units 12, 14 using a single long cabinet rail 16. However, for purposes of economy, it is preferred that the cabinet rail 16 be cut to relatively short lengths (e.g., 1 or 2 inches), and that two or more short cabinet rails be secured to the back side of each cabinet unit 12, 14 in spaced apart relationship, such as at opposite edges of the back side of the cabinet units 12, 14. Fastener openings 46 are formed in wall rail 10 and cabinet rail 16 to facilitate attachment to a vertical wall and the back side of cabinet units 12, 14, respectively.

As with wall rail 10, all flat surfaces (e.g., 48, 49 and 50) on the front of cabinet rail 16 are separated by smoothly curved surfaces (e.g., 51, 52), so that there are not any intersecting flat surfaces on the front side of cabinet rail 16 which would form a sharp edge. Because wall rail 10 and cabinet rail 16 are free of sharp edges, cabinet rail 16 can be easily slid down along the front surfaces (e.g., 30, 31, 32, 36, 37) of wall rail 10 without becoming snagged or caught-up. Instead, the front surfaces (e.g., 48, 49, 50, 51, 52) of cabinet rail 16 smoothly slide over the front surfaces (e.g., 30, 31, 32, 36, 37) of cabinet rail 16, and guide hook portion 40 (or 44) into channel 26 of wall rail 10, as shown in FIGS. 4A–4H, which progressively illustrate the position of cabinet rail 16 relative to wall rail 10 during installation of cabinet units 12, 14. The absence of any sharp edges on the fronts of wall rail 10 and cabinet rail 16 also reduce the possibility of damaging walls, cabinet units 12, 14, etc. on account of inadvertant contact with rails 10, 16 during installation of cabinet units 12, 14.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A wall rail system for suspending a cabinet unit on a wall, comprising:

an elongate wall rail having a cross-sectional configuration including a base portion and a hook portion which projects away and upwardly from the base portion, the base portion and hook portion together defining a channel, the wall rail having a planar back side adapted to be abuttingly secured to the wall and a front which is free of sharp edges; and a cabinet rail having a cross-sectional configuration including a base portion and a hook portion which projects away and downwardly from the base portion, and which is configured to be received in the channel defined by the base portion and hook portion of the elongate wall rail, the cabinet rail having a planar back side adapted to be abuttingly secured to the back side of the cabinet unit and a front which is free of sharp edges, whereby the front of the cabinet rail can smoothly slide over the front of the wall rail and guide the hook portion of the cabinet rail into the channel defined by the base portion and hook portion of the elongate wall rail during installation of the cabinet unit, wherein the front of the wall rail is comprised of alternating smooth and curved surfaces which form a ramp, and the front of the cabinet rail is comprised of alternating smooth and curved surfaces which form a ramp, whereby the surfaces on the front of the cabinet rail can cooperatively interact with the surfaces on the front of the wall rail to smoothly guide the downwardly projecting hook portion of the cabinet rail into the channel defined by the base portion and hook portion of the elongate wall rail.

2. The wall rail system of claim 1, wherein the cabinet rail includes a plurality of downwardly projecting hook portions to provide height adjustability for the cabinet unit.

3. A wall rail system for suspending a cabinet unit on a wall, comprising:

a cabinet rail having a cross-sectional configuration including a base portion and a hook portion which projects away and downwardly from the base portion, the cabinet rail having a planar back side adapted to be abuttingly secured to the back side of the cabinet unit; and an elongate wall rail having a cross-sectional configuration including a base portion, a first hook portion which projects away and downwardly from the base portion, and a second hook portion which projects away and upwardly from the base portion and toward the first hook portion of the elongate wall rail, the first hook portion of the elongate rail together with the base portion of the elongate rail defining a downwardly opening channel configured to receive the hook portion of the cabinet rail, the second hook portion of the elongate rail together with the base portion of the elongate rail defining an upwardly opening channel configured to receive the hook portion of the cabinet rail, whereby the first and second hook portions allow the elongate wall rail to be secured to the wall in either of two equivalent orientations to eliminate the possibility of securing the wall rail to the wall in an inoperable upside-down orientation.

4. The wall rail system of claim 3 in which the hook portion which projects away and downwardly from the base portion of the wall rail, and the hook portion which projects away and upwardly from the base portion of the wall rail are mirror images of each other.

5. The wall rail system of claim 3 in which the wall rail is symmetrical with respect to an imaginary horizontal plane intersecting the wall rail midway between an upper edge and a lower edge of the wall rail.

6. The wall rail system of claim 3, wherein the front of the wall rail is comprised of alternating smooth and curved surfaces which form a ramp, and the front of the cabinet rail is comprised of alternating smooth and curved surfaces which form a ramp, whereby the surfaces on the front of the cabinet rail can cooperatively interact with the surfaces on the front of the wall rail to smoothly guide the downwardly projecting hook portion of the cabinet rail into the upwardly opening channel defined by the base portion and second hook portion of the elongate wall rail.

7. The wall rail system of claim 3, wherein the cabinet rail includes a plurality of downwardly projecting hook portions to provide height adjustability for the cabinet unit.

8. A wall rail system for suspending a cabinet unit on a wall, comprising:

a cabinet rail having a cross-sectional configuration including a base portion and a hook portion which projects away and downwardly from the base portion, the cabinet rail having a planar back side adapted to be abuttingly secured to the back side of the cabinet unit and a front which is free of sharp edges; and an elongate wall rail having a cross-sectional configuration including a base portion, a first hook portion which projects away and downwardly from the base portion, and a second hook portion which projects away and upwardly from the base portion and toward the first hook portion of the elongate wall rail, the first hook portion of the elongate rail together with the base portion of the elongate rail defining a downwardly opening channel configured to receive the hook portion of the cabinet rail, the second hook portion of the elongate rail together with the base portion of the elongate rail defining an upwardly opening channel, the first and second hook portions allowing the elongate wall rail to be secured to the wall in either of two equivalent orientations to eliminate the possibility of securing the wall rail to the wall in an inoperable upside-down orientation, the wall rail having a planar back side adapted to be abuttingly secured to the wall and a front which is free of sharp edges, whereby the front of the cabinet rail can smoothly slide over the front of the wall rail and guide the hook portion of the cabinet rail into the channel defined by the base portion and second hook portion of the elongate wall rail during installation of the cabinet unit.

9. The wall rail system of claim 8, wherein the front of the wall rail is comprised of alternating smooth and curved surfaces which form a ramp, and the front of the cabinet rail is comprised of alternating smooth and curved surfaces which form a ramp, whereby the surfaces on the front of the cabinet rail can cooperatively interact with the surfaces on the front of the wall rail to smoothly guide the downwardly projecting hook portion of the cabinet rail into the channel defined by the base portion and second hook portion of the elongate wall rail.

10. The wall rail system of claim 8, wherein the cabinet rail includes a plurality of downwardly projecting hook portions to provide height adjustability for the cabinet unit.

11. The wall rail system of claim 8 in which the hook portion which projects away and downwardly from the base portion of the wall rail, and the hook portion which projects away and upwardly from the base portion of the wall rail are mirror images of each other.

12. The wall rail system of claim 8 in which the wall rail is symmetrical with respect to an imaginary horizontal plane intersecting the wall rail midway between an upper edge and a lower edge of the wall rail.

13. A wall rail system for suspending a cabinet unit on a wall, comprising:

an elongate wall rail having a cross-sectional configuration including a base portion and a hook portion which projects away and upwardly from the base portion, the base portion and hook portion together defining a channel, the wall rail having a planar back side adapted to be abuttingly secured to the wall; and a cabinet rail having a cross-sectional configuration including a base portion and a hook portion which projects away and downwardly from the base portion, and which is configured to be received in the channel defined by the base portion and hook portion of the elongate wall rail, the cabinet rail having a planar back side adapted to be abuttingly secured to the back side of the cabinet unit, the front of the wall rail and the front of the cabinet rail having smoothly ramped surfaces which allow the front of the wall rail to smoothly guide the downwardly projecting hook portion of the cabinet rail into the channel defined by the base portion and hook portion of the elongate wall rail.

* * * * *

UNITED STATES PATENT AND TRADEMARK OFFICE

CERTIFICATE OF CORRECTION

PATENT NO. : 6,113,201
DATED : September 5, 2000
INVENTOR : Thomas E. Bauer

It is certified that error appears in the above-identified patent and that said Letters Patent is hereby corrected as shown below:

*Column 2, line 15:

"SUMAMRY" should be - -SUMMARY- -;

*Column 2, line 20:

"systems" should be - -systems- -.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*